US006162517A

United States Patent [19]

Oshima et al.

[11] Patent Number: 6,162,517

[45] Date of Patent: Dec. 19, 2000

[54] IMAGE-RECEIVING SHEET FOR THERMAL TRANSFER PRINTING

[75] Inventors: Katsuyuki Oshima; Atsushi Tatehana; Koichi Shirai; Mineo Yamauchi; Kazunobu Imoto, all of Tokyo-to, Japan

[73] Assignee: Dai Nippon Printing Co., Ltd., Tokyo-to, Japan

[21] Appl. No.: 08/855,120

[22] Filed: May 13, 1997

[30] Foreign Application Priority Data

May 14, 1996 [JP] Japan ..... 8-142337
May 14, 1996 [JP] Japan ..... 8-143748

[51] Int. Cl.[7] ..... G09F 3/10

[52] U.S. Cl. ..... 428/40.1; 428/137; 428/138; 428/213; 428/194; 428/913; 428/914; 503/227

[58] Field of Search ..... 428/40.1, 913, 428/914, 194, 137, 138, 213; 503/227

[56] References Cited

U.S. PATENT DOCUMENTS 5,356,853 10/1994 Ueno ..... 428/913
5,472,757 12/1995 Ogawa ..... 428/40.2
5,534,477 7/1996 Nakamura ..... 428/913
5,811,371 9/1998 Egashira ..... 428/195

FOREIGN PATENT DOCUMENTS 3126661 12/1991 Japan .

*Primary Examiner*—Nasser Ahmad
*Attorney, Agent, or Firm*—Ladas & Parry

[57] ABSTRACT

The present invention provides a thermal transfer image-receiving sheet comprises (1) an adhesive sheet portion 1 comprising a support 2, a dye receptor layer 3 disposed on a front surface of the support and an adhesive layer 4 disposed on a back surface of the support and (2) a release sheet 5 temporarily bonded to the adhesive layer so as to be peelable therefrom. The support 2 is a layered product comprising a foamed resin film layer 6 disposed on a dye receptor layer side thereof and a non-foamed resin film layer 7 disposed on an adhesive layer side thereof. In the adhesive sheet portion 1, it is preferable to form a cut line 9 which is provided with at least one uncut portion.

10 Claims, 5 Drawing Sheets

IMAGE-RECEIVING SHEET FOR THERMAL TRANSFER PRINTING

BACKGROUND OF THE INVENTION

The present invention relates to an image-receiving sheet for thermal transfer printing such as an image-receiving sheet provided with a dye receptor layer capable of receiving sublimation dye transferring from a sublimation thermal transfer sheet, and particularly relates to a thermal transfer image-receiving sheet which can widely be utilized in a field of various kind of color printers such as a video printer.

In recent years, there has been remarkable progress in a photographing technology and systems for formation of images exemplified by computer graphics. Along with such progress, there has been a great demand for making colored hard copies of images.

Sublimation thermal transfer method is known as one of systems for making colored hard copies. According to the sublimation thermal transfer method, a thermal transfer sheet using sublimation dye as recording agent is placed on a thermal transfer image-receiving sheet, and then the sublimation dye is transferred to the thermal transfer image-receiving sheet by heating the thermal transfer sheet in correspondence with electric record signals for printing with the use of a heating means such as a thermal head, whereby images are printed.

Of many kinds of systems for making colored hard copies, public attention has been attracted by the sublimation thermal transfer method, because that method is excellent in such various properties of an obtained image as transparency, reproducibility of gradation in neutral tints and reproducibility of colors, and it is possible to realize a high quality image being equal to silver salt photograph.

There is also known as one of such a sublimation thermal transfer image-receiving sheet, that of a pressure sensitive adhesive sheet type. That type of sublimation thermal transfer image-receiving sheet is provided with a dye receptor layer having adhesiveness on its back surface and a release sheet such as a release paper temporarily bonded to the adhesive back surface of the receptor layer. The Dye receptor layer of such an image-receiving sheet is peeled off the release sheet after the formation of desired images, and then stuck to any object.

FIGS. 8, 9 and 10 show one example of prior art with respect to such a sublimation thermal transfer image-receiving sheet of the pressure sensitive adhesive sheet type, and FIG. 9 is an enlarged Y—Y sectional view of FIG. 8. As shown in FIG. 8, this sublimation thermal transfer image-receiving sheet is of a continuously long sheet having a certain width, which is subjected to a half-cut process to form a prescribed shape defined by cut lines (half-cut lines) 59. A reference numeral 62 in FIG. 8 indicates a detection mark.

As shown in FIG. 9, this sublimation thermal transfer image-receiving sheet is prepared by laminating, on a release surface of a release sheet 55, a layered product which is composed of an adhesive layer 54 adhering to the above-mentioned release surface, a support 52 made of sheet-like material such as a foamed polyethylene terephthalate (PET) film and a synthetic paper called "YUPO" (product name), and a dye receptor layer (i.e. a layer of resin having dyeing property) 53 formed on the support 52. The cut line (half-cut line) 59 stops at a depth corresponding to a thickness of the adhesive layer 54. Therefore, the release sheet 55 is not divided by the cut line (half-cut line) 59.

As shown in FIG. 8, such sublimation thermal transfer image-receiving sheet both ends of which are wound around cores 63 for wind respectively is mounted in a printer, and fed toward a direction indicated by an arrow or a direction opposite thereto. Then a sublimation thermal transfer sheet (not shown in FIG. 8) is placed on the sublimation thermal transfer image-receiving sheet. Thereafter, sublimation dye of the sublimation thermal transfer sheet is transferred to the surface of the sublimation thermal transfer image-receiving sheet by heating the sublimation thermal transfer sheet in correspondence with the image to be printed from its back surface side with the use of a heating means such as the thermal head to form a desired image 60 in an area defined on the sublimation thermal transfer image-receiving sheet by the cut line 59.

The area in which the image 60 (for example, a photograph of portrait) has been given is separated from a surrounding portion by the cut ine 59 as the border line, and peeled off the release sheet 55 together with the adhesive layer 54. Then, as shown in FIG. 10, the thus peeled portion A of the dye receptor layer in which the image 60 has been given is stuck to an object 65 such as a notebook, a pocketbook, a bag, and the like.

As mentioned above, in the conventional art, the foamed resin film or the synthetic paper is used as the support 52 of the thermal transfer image-receiving sheet so as to bear an impact force given from the thermal head, and so as to prevent diffusion of heat given from the thermal head.

However, because the area defined by the cut line 59 is comparatively narrow, when the minute or highly detailed image 60 in various colors is formed in such a narrow area, lowering of a density of the image is liable to be caused, particularly at a high density portion in the image such as a black portion colored by superimposition with colors of yellow, cyan and magenta, resulting in occurrence of a problem that the obtained image is weak in a visual impression, that is, lack of so called punch, and the image is blur. Under such circumstances, there has been required to realize a formation of a powerful image having so-called punch.

Besides, when the image is printed with the use of the conventional thermal transfer image-receiving sheet as shown in FIG. 8, the thermal transfer image-receiving sheet both ends of which are wound around the cores 63 respectively is fed through a platen roller and another roller in the printer for formation of the image, and thereafter, a portion of the thermal transfer image-receiving sheet, in which the image is to be given is locally heated by the thermal head and the like to form the desired image. During the printing process mentioned above, there may occur a phenomenon that an edge portion of the area defined by the cut line 59 is turned up through a bend of the thermal transfer image-receiving sheet when the thermal transfer image-receiving sheet passes through the roller portion or another portion, with the result that the area is peeled off. Furthermore, because the area to be peeled has the adhesive layer formed on its back surface, the peeled piece of the area may adhere to the thermal head or another portion in the printer. Accordingly, there has been caused a problem that a feeding or carrying obstruction of the thermal transfer image-receiving sheet occurs in the printer to interrupt the printing process.

The above problem may be solved by increasing an adhesive strength of the adhesive layer. However, when the adhesive strength of the adhesive layer is increased, there occurs a problem of difficulty in peeling of the half-cut area after formation of the image, and occurs another problem that a part of the area to be peeled is torn at the time of peeling.

SUMMARY OF THE INVENTION

The first object of the present invention is therefore to provide an image-receiving sheet for thermal transfer printing which is capable of forming a powerful image having so-called punch.

The second object of the present invention is to provide an image-receiving sheet for thermal transfer printing subjected to a half-cut process to define half-cut areas, which causes no peeling of the half-cut areas during formation of the image in a thermal transfer printer, and furthermore, which is easy in peeling of the half-cut areas after formation of the image.

The image-receiving sheet for thermal transfer printing provided by the present invention comprises (1) an adhesive sheet portion comprising a support, a dye receptor layer disposed on a front surface of said support and an adhesive layer disposed on a back surface of said support and (2) a release sheet temporarily bonded to said adhesive layer of said adhesive sheet portion so as to be peelable therefrom, said support being a layered product comprising a foamed resin film layer disposed on a dye receptor layer side of said support and a non-foamed resin film layer disposed on an adhesive layer side of said support.

The foamed resin film layer disposed on the dye receptor layer side of the support has an excellent cushion property to bring the heating means such as the thermal head into closer contact with the dye receptor layer of the thermal transfer image-receiving sheet by the medium of the dye layer of the thermal transfer sheet. Furthermore, the foamed resin film layer prevents thermal energy given by the heating means from being diffused because of its excellent heat reserve property, thereby keeping the thermal energy in a boundary face between the heating means and the dye receptor layer of the thermal transfer image-receiving sheet. On the other hand, the non-foamed resin film layer disposed on the adhesive layer side of the support receives an impact force given by the heating means such as a thermal head, and simultaneously improves a momentary close contact between the dye layer and the dye receptor layer in the printing process.

Therefore, when the above-mentioned image-receiving sheet for thermal transfer printing of the present invention is used, the dye is transferred well even to a portion in which high density of the image is required, whereby formation of the powerful image having so-called punch is realized. Particularly, according to the thermal transfer image-receiving sheet of the present invention, when a minute or highly detailed image is formed in each of areas into which the adhesive sheet portion is divided by cut lines (half-cut lines), it is also possible to form the powerful image having so-called punch.

When the cut line which defines the area peelable from the release sheet is formed in the adhesive sheet portion of the thermal transfer image-receiving sheet of the present invention, it is preferable to leave at least one portion of the cut line uncut. Such an uncut portion prevents the area defined by the cut line from being turned up and peeled when the thermal transfer image-receiving sheet is fed in a thermal transfer printer.

DESCRIPTION OF THE PREFERRED EMBODIMENT

Figure 1:
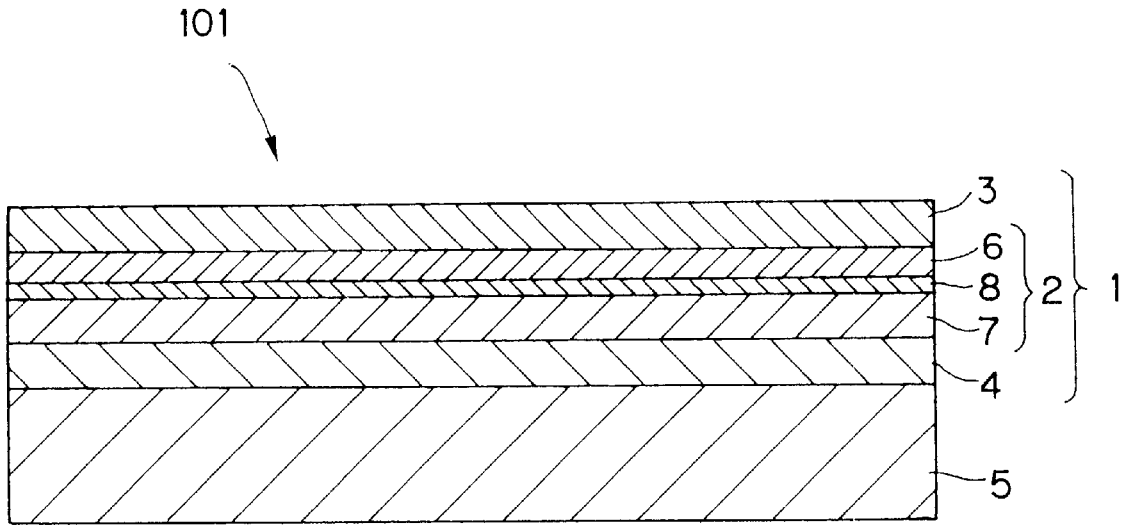
FIG. 1 is a schematic sectional view of one example with respect to a first embodiment of the image-receiving sheet according to the present invention.

The present invention will be described further in detail hereunder with reference to preferred exemplary embodiments thereof. The same reference numeral is used for the same or corresponding portion through different examples shown in the figures.

A thermal transfer image-receiving sheet according to a first embodiment of the present invention comprises (1) an adhesive sheet portion comprising a support, a dye receptor layer disposed on a front surface of the support and an adhesive layer disposed on a back surface of the support and (2) a release sheet temporarily bonded to the adhesive layer side of the adhesive sheet portion so as to be peelable therefrom; the support is a layered product comprising a foamed resin film layer disposed on the dye receptor layer side of the support and a non-foamed resin film layer disposed on the adhesive layer side of the support. The use of this thermal transfer image-receiving sheet enables to form a powerful image having so-called punch.

FIG. 1 shows a schematic sectional view of one example (101) with respect to the first embodiment. The thermal transfer image-receiving sheet 101 shown in FIG. 1 comprises (1) the adhesive sheet portion 1 comprising a support 2, the dye receptor layer 3 disposed on the front surface of the support and the adhesive layer 4 disposed on the back surface of the support and (2) the release sheet 5 temporarily bonded to the adhesive layer side of the adhesive sheet portion so as to be peelable therefrom. The above-mentioned support 1 is the layered product having three layers, more specifically, having the foamed resin film layer 6 disposed on the dye receptor layer side of the support, the non-foamed resin film layer 7 disposed on the adhesive layer side of the support and a bonding agent layer 8 for bonding these two layers to each other. Besides, an intermediate layer which does not appear in FIG. 1 may be disposed between the support 2 and the dye receptor layer 3 as the occasion demands.

Figure 2:
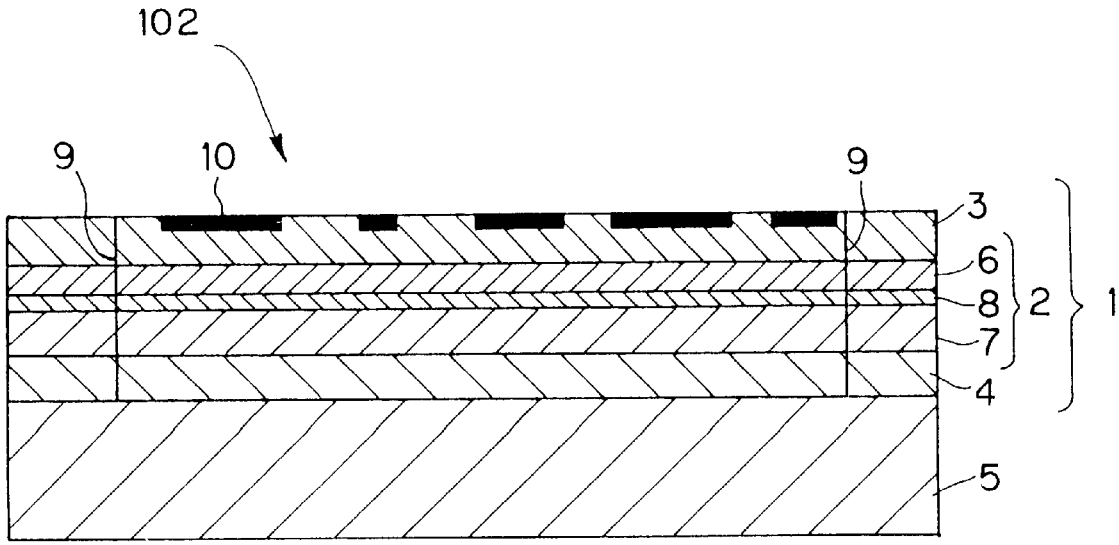
FIG. 2 is a schematic sectional view of another example with respect to the first embodiment of the image-receiving sheet.

FIG. 2 shows a schematic sectional view of another example (102) with respect to the first embodiment. The thermal transfer image-receiving sheet 102 shown in FIG. 2 is the same as the image-receiving sheet 101 shown in FIG. 1 except that the adhesive portion 1 is nicked to make cut lines (half-cut lines) 9 each of which defines the adhesive portion 1 into an area having an optional shape. Therefore, each area of the adhesive portion 1 is able to be peeled off the release sheet 5.

As the release sheet 5, in the present invention, there may be used any kinds of known conventional release sheets, for example, a sheet formed by subjecting the surface of the plastic film or the poly-laminated paper, preferably the plastic film such as the polyethylene terephthalate film to the releasability improving treatment with the use of known release agent such as silicone. More specifically, concrete examples thereof include LUMIRROR T-60 having a thickness of 50 μm (manufactured by Toray Co., Ltd.) and W-400 having a thickness of 38 μm (manufactured by Diafoil Co., Ltd.)

It is preferable to limit the thickness of the release sheet within a range of 20 to 100 μm. When the release sheet is excessively thin, the obtained thermal transfer image-receiving sheet becomes insufficient in a sturdiness (i.e. a sturdy property), making it to be difficult to let out the thermal transfer image-receiving sheet from the roll, and otherwise causing the thermal transfer image-receiving sheet to be crumpled. On the other hand, when the release sheet is excessively thick, the obtained thermal transfer image-receiving sheet becomes excessively thick, making it to be difficult to supply the thermal transfer image-receiving sheet into the transfer printer at the time of feed.

As the adhesive for forming the adhesive layer 4, there may be used any kinds of known conventional adhesives such as an organic solvent type and an aqueous type. An applied amount of the adhesive to the release sheet is normally within a range of about 8 to about 30 g/m$^2$ in a solid content. The adhesive strength (i.e., the peel strength) is preferably limited within a range of about 50 to about 900 gf in term of JIS P8139 test, more preferably about 100 to about 750 gf.

As the resin film for the non-foamed resin film layer 7, there may be used any kinds of known conventional non-foamed resin films, for example, non-foamed resin films made of polyethylene terephthalate, polyethylene or polypropylene; concretely preferable examples thereof include LUMIRROR S-10 having a thickness of 12 μm (manufactured by Toray Co., Ltd.)

The non-foamed resin film preferably has a thickness within a range of about 10 to about 50 μm. When the non-foamed resin film is excessively thin, the obtained thermal transfer image-receiving sheet is not sturdy. Furthermore, when the thermal transfer image-receiving sheet having the excessively thin non-foamed resin film layer is heated by the thermal head and the like in order to form the image, the thermal transfer image-receiving sheet is liable to be curled due to heat shrinkage. On the other hand, when the non-foamed resin film is excessively thick, the thermal transfer image-receiving sheet is too sturdy to be restored to an originally flat shape. Therefore, when the thermal transfer image-receiving sheet having the excessively thick non-foamed resin film layer is wound around the platen to be heated for printing, the thermal transfer image-receiving sheet becomes curly according to the shape of the platen. That is, the thermal transfer image-receiving sheet is liable to be curled due to a heat setting.

As the resin film for the foamed resin film layer 6, there may be used any kinds of known conventional foamed resin films, for example, foamed resin films made of polypropylene or polyethylene terephthalate. The foamed polypropylene film is more preferably used with respect to its cushioning property. Concrete examples thereof include TOYOPEARL P4255 having a thickness of 35 μm and TOYOPEARL P4256 having a thickness of 60 μm (manufactured by Toyo boseki Co., Ltd. respectively), each of which is commercially available. The foamed resin film preferably has a thickness in a range of about 30 to about 60 μm.

In order to laminate the non-foamed resin film layer 7 and the foamed resin film layer 6, two films for these layers are normally bonded to each other through the bonding agent layer 8. As the lamination method, there may be applied any kinds of known conventional methods, for example, the dry lamination, the non-solvent lamination (i.e., the hot lamination), the EC lamination. Preferable methods include the dry lamination and the non-solvent lamination. Preferable bonding agents for the non-solvent lamination include TAKENATE A-720L (manufactured by Takeda Yakuhin Kogyo Co., Ltd.). Preferable bonding agents for the dry lamination include a mixture of TAKELAC A969/TAKENATE A-5 (3/1). An applied amount of the bonding agent is normally within a range of about 1 to about 8 g/m$^2$ in a solid content, preferably about 2 to about 6 g/m$^2$ in a solid content.

The dye receptor layer 3 may be formed on the foamed resin film before the lamination process of the foamed resin film and the non-foamed resin film. Otherwise, it may be formed on the foamed resin film layer side of the support 2 which is obtained through lamination of the foamed resin film and the non-foamed resin film. Furthermore, the dye receptor layer 3 may be formed on the foamed resin film layer side of the support 2 after lamination of the support 2 and the release sheet 5.

A material for the dye receptor layer 3 may be optionally selected in correspondence with an applied thermal transfer method. In case of the sublimation thermal transfer image-receiving sheet, examples of the material for the dye receptor layer 3 include: polyolefine resins such as polypropylene; vinyl chloride-vinyl acetate copolymer; ethylene-vinyl acetate copolymer; halogenated polymers such as polyvinylidene chloride; polyester resins such as polyvinyl acetate and polyacrylic ester; polystyrene resins; polyamide resins; copolymer resins comprising olefine monomers (for example, ethylene and propylene) and another vinyl monomer; ionomer; cellulose resins such as cellulose diacetate; polycarbonate. Of these materials, polyester resins, vinyl chloride-vinyl acetate copolymer and mixtures thereof are preferably used.

A release agent may be added to the resin for the dye receptor layer mentioned above in order to prevent the dye layer of the thermal transfer sheet (particularly the sublimation thermal transfer sheet) and the dye receptor layer of the thermal transfer image-receiving sheet from being fused to each other during formation of the image, or in order to prevent degradation of the sensitivity in printing during formation of the image. Preferable release agents to be added include silicone oils, phosphoric ester type surface active agents and fluorine type surface active agents. Of these release agents, the silicone oils are more preferably used. As the silicone oils, there may be preferably used modified silicone oils such as epoxy-modified, vinyl-modified, alkyl-modified, amino-modified, carboxyl-modified, alcohol-modified, fluorine-modified, alkyl aralkyl polyether-modified, epoxy-polyether-modified and polyether-modified silicone oils.

The release agent may be used singly or in combination of two or more kinds thereof. A blended amount of the release agent is preferably limited within a range of about 0.5 to about 30 weight parts to 100 weight parts of the resin for forming the dye receptor layer. When the blended amount thereof is out of the above-mentioned range, there may be caused problems such as the fusion between the dye layer of the thermal transfer sheet and the dye receptor layer of the thermal transfer image-receiving sheet, degradation of the sensitivity in printing and the like.

Such a release agent added to the dye receptor layer bleeds out from the surface of the dye receptor layer at the time of heating in the transferring process to effect releasability. Besides, the release agent may be applied to the surface of the dye receptor layer, not blended with the resin for forming the dye receptor layer.

The dye receptor layer may be formed by: blending the release agent and/or another additive with the above-mentioned resin for the dye receptor layer as occasion demands; dissolving the thus blended resin in the proper organic solvent or dispersing the blended resin in the organic solvent or water to prepare a liquid for coating; applying the liquid for coating onto the surface of the foamed resin film layer 6 with the use of the proper method; and thereafter drying the same.

In the formation of the dye receptor layer, there may be added white pigment, fluorescent whitening agent and the like in order to increase whiteness of the dye receptor layer to further improve clearness of the transferred image. A thickness of the thus formed dye receptor layer is not limited to a specific range, but normally in a range of about 1 to about 50 $\mu$m. Furthermore, an antistatic agent may be applied to the dye receptor layer in order to stabilize the feeding action in the printer.

On the surface of the thermal transfer image-receiving sheet opposite to the surface having the dye receptor layer (i.e., the back surface side of the release sheet), any proper slip layer which is not shown in FIGS. may be disposed in order to prevent double feed caused at the time when the thermal transfer image-receiving sheet is supplied into the printer. As a material for the slip layer, there may be used: known conventional resin such as butyral resin, polyacrylate, polymethacrylate, polyvinylidene chloride, polyester, polyurethane, polycarbonate and polyvinyl acetate; and a mixture made by blending two or more kinds of the above resins and adding a lubricant such as various kinds of particulate and silicone thereto.

In the preferred example of the present invention, the above-mentioned thermal transfer image-receiving sheet is subjected to the half-cut process. As a device for half-cutting, there may be used any known conventional device, for example, a device provided with a level seat made of an elastic body, a linear cutter blade having a predetermined shape which is disposed on the seat so as to be adjustable in its height and an upper die capable of a vertical movement. The half-cut line having a desired shape is able to be formed in the thermal transfer image-receiving sheet by: inserting the thermal transfer image-receiving sheet between the upper die and the seat; adjusting the height of the blade; and vertically moving the die. Needless to say, the rotary cutter of the cylinder type may be used instead of the above-mentioned device.

The image is able to be printed on the thermal transfer image-receiving sheet of the present invention formed as mentioned above. In case of the sublimation thermal transfer printing, the thermal transfer image-receiving sheet of the present invention may be used as follows: the desired image in the various colors is formed in the dye receptor layer 3 of the thermal transfer image-receiving sheet by the known thermal head type printer with the use of the thermal transfer sheet on which three colors of the dye layers consisting of yellow (Y), cyan (C) and magenta (M) are alternately and sequentially arranged side by side; the adhesive sheet portion 1 having the dye receptor layer 3 bearing the thus formed image and the adhesive layer of the back surface side is peeled from the release sheet 5; and the thus peeled adhesive sheet portion 1 is stuck to any object.

Figure 10:
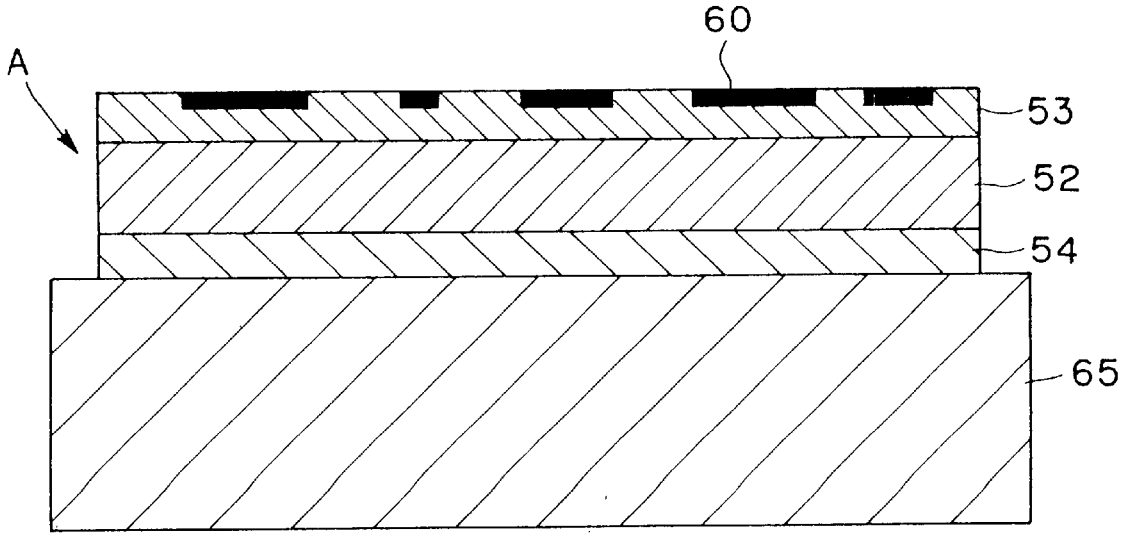
FIG. 10 PRIOR ART
FIG. 10 is a schematic sectional view showing that a peeled area bearing image is stuck to an object.

In case where the thermal transfer image-receiving sheet is subjected to the half-cut process, it may be used in the same way shown in FIG. 10. That is, the image is formed in each of the areas defined by the cut line, and thereafter each area is peeled from the release sheet and stuck to any object 65.

According to the above-mentioned first embodiment of the present invention, the dye receptor side of the support is made of the foamed resin film, and the adhesive layer side of the support is made of the non-foamed resin film. Thus, the foamed resin film prevents the diffusion of the thermal energy, and simultaneously brings the heating means into closer contact with the thermal transfer image-receiving sheet; on the other hand, the non-foamed resin film receives the impact force given by the heating means, and simultaneously improves the momentary close contact between the image-receiving sheet and the transfer sheet.

Therefore, the dye is able to be transferred well even to the portion in which high density of the image is required, whereby there is provided the thermal transfer image-receiving sheet capable of forming the powerful image having so-called punch. Particularly, according to the invention of the first embodiment, it is possible to provide the thermal transfer image-receiving sheet capable of forming the powerful image having so-called punch even in the narrow area defined by half-cutting of the thermal transfer image-receiving sheet.

EXAMPLE A

The first embodiment of the present invention will be described hereunder more in detail by way of experiment examples, in which a term "part(s)" or "%" generally denotes weight part(s) or weight %, though not mentioned specifically.

Example A-1

First, the coating material for the dye receptor layer having the following composition was applied onto one surface of the foamed polypropylene film (MW846, thickness of 35 $\mu$m, manufactured by Mobil Co., Ltd.) in an applied amount of 4.0 g/m$^2$ (in solid content), and then dried to form the dye receptor layer.

| <Material For Dye Receptor Layer> | |
|---|---|
| Vinyl chloride - vinyl acetate copolymer (#1000A, manufactured by Denkikagaku Kogyo Co., Ltd.) | 40 parts |
| Polyester (BYLON 600, manufactured by Toyo boseki Co., Ltd.) | 40 parts |
| Vinyl chloride - styrene - acrylic acid copolymer (DENKALAC#400A, manufactured by Denkikagaku Kogyo Co., Ltd.) | 20 parts |
| Vinyl-modified silicone (X-62-1212, manufactured by Shinetsu Kagaku Kogyo Co., Ltd.) | 10 parts |
| Catalyst (CAT-PLR-5, manufactured by Shinetsu Kagaku Kogyo Co., Ltd.) | 5 parts |

-continued

| <Material For Dye Receptor Layer> | |
|---|---|
| Catalyst (CAT-PL-50T, manufactured by Shinetsu Kagaku Kogyo Co., Ltd.) | 6 parts |
| Methyl ethyl ketone/Toluene (1/1) | 400 parts |

Next, the bonding agent having the following composition was applied onto the other surface of the above-mentioned foamed polypropylene film in an applied amount of 3.0 g/m$^2$ (in solid content), on which the dye receptor layer was not formed, and furthermore, the polyethylene terephthalate (PET) film (TRANSPARENT PET T-60, thickness of 25 $\mu$m, manufactured by Toray Co., Ltd.) was placed thereon.

| <Bonding Agent> | |
|---|---|
| Urethane resin (TAKELAC A-969V, manufactured by Takeda Yakuhin Co., Ltd.) | 30 parts |
| Isocyanate curing agent (TAKENATE A-5, manufactured by Takeda Yakuhin Co., Ltd.) | 10 parts |
| Ethyl acetate | 80 parts |

The adhesive having the following composition was applied onto the exposed surface of the thus bonded PET film in an applied amount of 15.0 g/m$^2$ (in solid content), and then dried by heating same at a temperature of 70° C. for one minute to form the adhesive layer.

| <Adhesive> | |
|---|---|
| Acrylic copolymer (SK DYNE 1310L, manufactured by Soken Kagaku Co., Ltd.) | 48 parts |
| Epoxy resin (CURING AGENT E-AX, manufactured by Soken Kagaku Co., Ltd.) | 0.36 part |
| Ethyl acetate | 51.64 parts |

On the other hand, another transparent PET film having a thickness of 38 $\mu$m (manufactured by Toray Co., Ltd.) was prepared, and the release agent having the following composition was applied onto one surface thereof in an applied amount of 0.2 g/m$^2$ (in solid content), and then dried by heating same at a temperature of 130° C. for thirty seconds to form the release layer. Thereafter, the previously formed layered product mentioned above was laminated on the latter PET film so as to make the adhesive layer side of the layered product opposite to the release layer side of the PET film.

| <Release Agent> | |
|---|---|
| Addition reaction type silicone for the paper (KS-778, manufactured by Shinetsu Kagaku Kogyo Co., Ltd.) | 32 parts |
| Catalyst (CAT-PL-8, manufactured by Shinetsu Kagaku Kogyo Co., Ltd.) | 0.32 parts |
| Toluene | 67.68 parts |

Finally, the diluted solution having a diluted ratio of 1/1000 of quaternary ammonium salt compound (TB-34, manufactured by Matsumoto Yushi Seiyaku Co., Ltd.) was applied as the antistatic agent onto the dye receptor layer to prepare the thermal transfer image-receiving sheet of the present invention.

Example A-2

Figure 8:
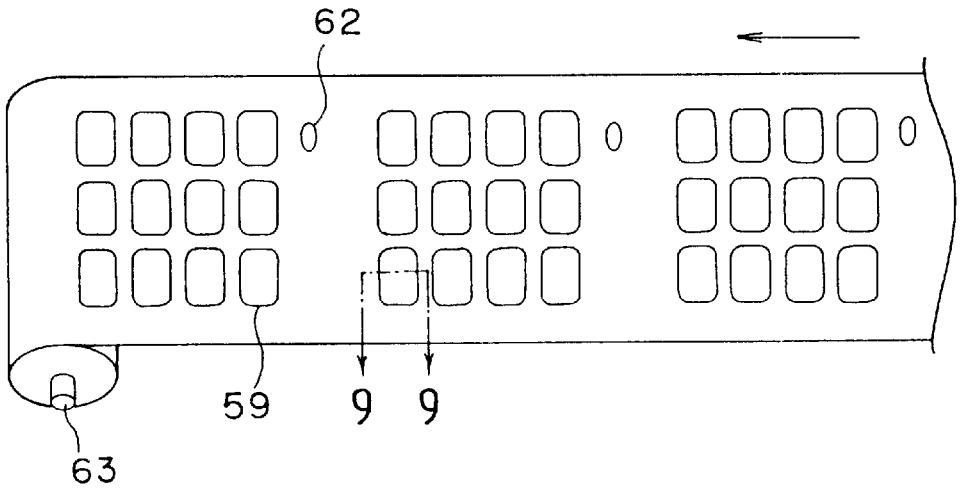
FIG. 8 PRIOR ART
FIG. 8 is a plan view schematically showing a conventional thermal transfer image-receiving sheet subjected to a half-cut process.
Figure 9:
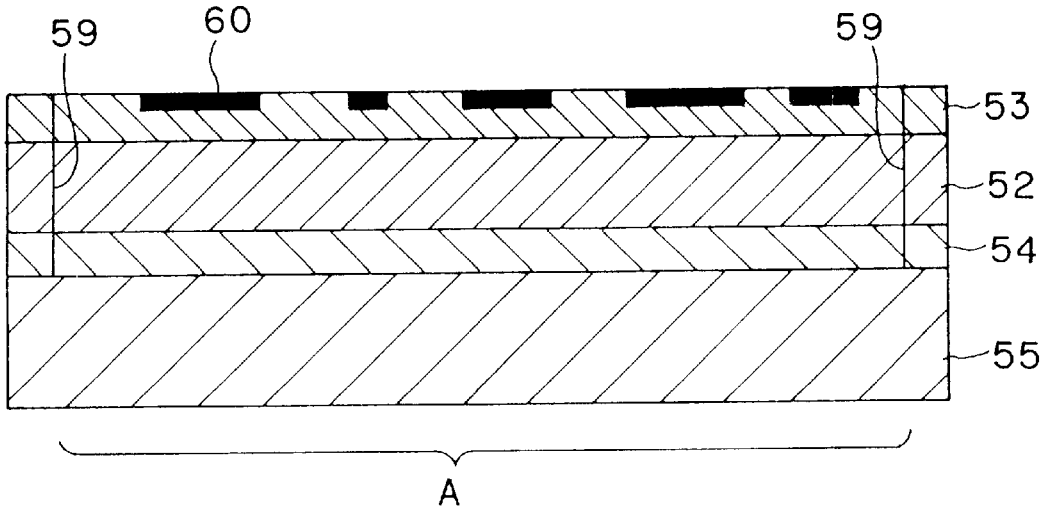
FIG. 9 PRIOR ART
FIG. 9 is a sectional view taken along lines 9—9 of FIG. 8.

The thermal transfer image-receiving sheet obtained in Example A-1 was made into the form shown in FIG. 8 through the half-cut process so as not to cut the portion of the release film, whereby the thermal transfer image-receiving sheet of the present invention having the half-cut areas was obtained. A size of the each section having a set of the half-cut areas was 110 mm×110 mm, and as shown in FIG. 8, twelve small areas having a size of 20 mm×15 mm respectively were arranged in the each section.

Comparative Example A-1

The same steps as those in Example A-1 and Example A-2 were carried out to obtain the thermal transfer image-receiving sheet of the comparative example which was subjected to the half-cutting process, except that the foamed PET film (W-100, thickness of 50 $\mu$m, manufactured by Diafoil Co., Ltd.) was used as the support instead of the layered product provided with the foamed resin film layer and the non-foamed resin film layer.

Comparative Example A-2

The same steps as those in Example A-1 and Example A-2 were carried out to obtain the thermal transfer image-receiving sheet of the comparative example which was subjected to the half-cutting process, except that the synthetic paper (YUPO FPU, thickness of 60 $\mu$m, manufactured by Ohji Yuka Co., Ltd.) was used as the support instead of the layered product provided with the foamed resin film layer and the non-foamed resin film layer.

[Test And Results]

The image was formed on each of the obtained thermal transfer image-receiving sheets through the sublimation thermal transfer printing, and the printed matter was tested with respect to density of coloring and quality of the image.

First, the sublimation thermal transfer sheet (manufactured by Dai Nippon Printing Co., Ltd.) on which three colors of the dye layers consisting of yellow (Y), cyan (C) and magenta (M) were alternately and sequentially arranged side by side was laid on each thermal transfer image-receiving sheet of the examples or the comparative examples so as to make the dye layer and the dye receptor layer opposite to each other.

Next, the thermal transfer sheet was heated from its back surface side by the thermal head under the condition consisting of an applied head-voltage of 12.0 V, a pulse width of 16 msec., a printing cycle of 33.3 msec. and a dot density of 6 dots/line to record on the thermal transfer image-receiving sheet, whereby the photograph of the portrait in various colors was printed on the dye receptor layer of the thermal transfer image-receiving sheet.

The printed matter thus obtained was tested with respect to density of coloring and quality of the image. The method and criterion for each evaluation are as follows. The results are shown in TABLE 1.

<Density Of Coloring>

The density of coloring was measured by the densitometer (RD-918, manufactured by Macbeth Co., Ltd. in USA)

<Image Quality>

The quality of the image was evaluated by visual observation on the basis of the following criterion.

Criterion

○: The image is excellent in expression of light and shade, clear and powerful.

×: The image is flat-looking and blur.

TABLE 1

| Number of Example | Density of Coloring | Image Quality |
|---|---|---|
| Example A-1 | 2.56 | ○ |
| Example A-2 | 2.56 | ○ |
| Comparative Example A-1 | 1.84 | X |
| Comparative Example A-2 | 2.14 | X |

A thermal transfer image-receiving sheet of a second embodiment of the present invention comprises (1) an adhesive sheet portion comprising a support, a dye receptor layer disposed on a front surface of the support and an adhesive layer disposed on a back surface of the support and (2) a release sheet temporarily bonded to the adhesive layer side of the adhesive sheet portion so as to be peelable therefrom; the adhesive sheet portion is nicked to make at least one cut line (half-cut line) by each of which the adhesive sheet portion is divided into an area having an optional shape; and the cut line defining the area is provided with at least one uncut portion. According to this thermal transfer image-receiving sheet, at the time of the feeding thereof in a printer, the area which is defined by the cut line is prevented from being turned up and peeled off.

Figure 3:
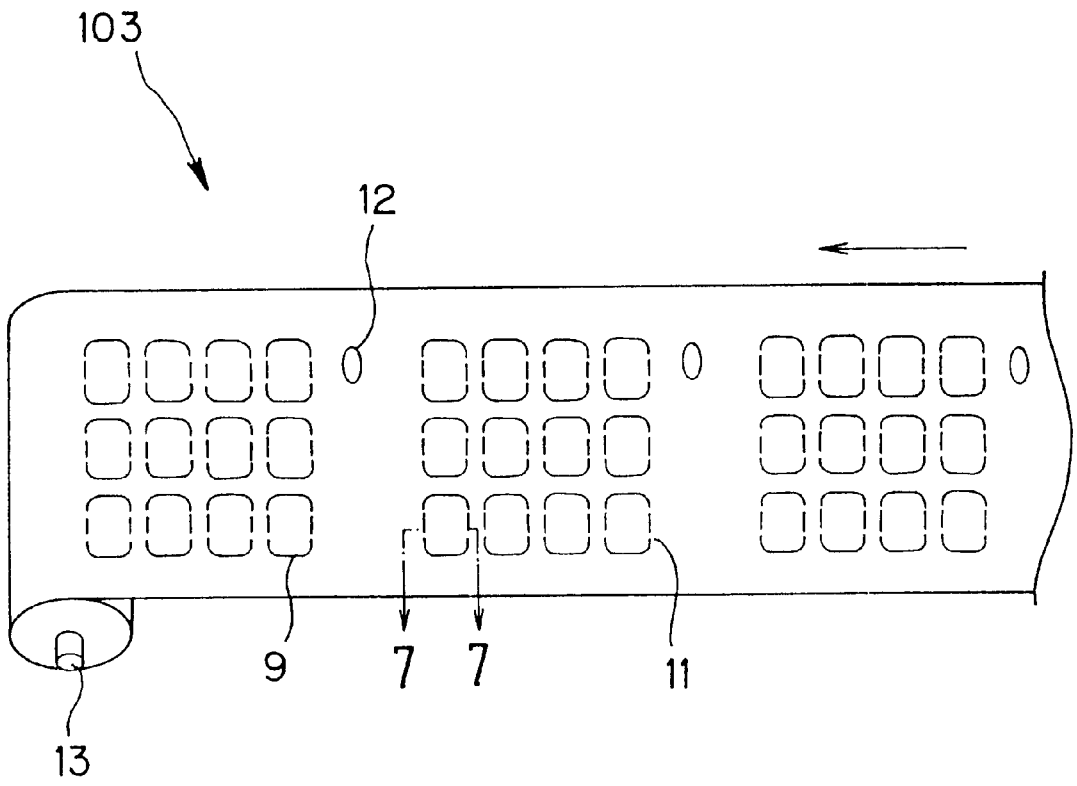
FIG. 3 is a plan view of one example with respect to a second embodiment of the image-receiving sheet according to the present invention.
Figure 4:
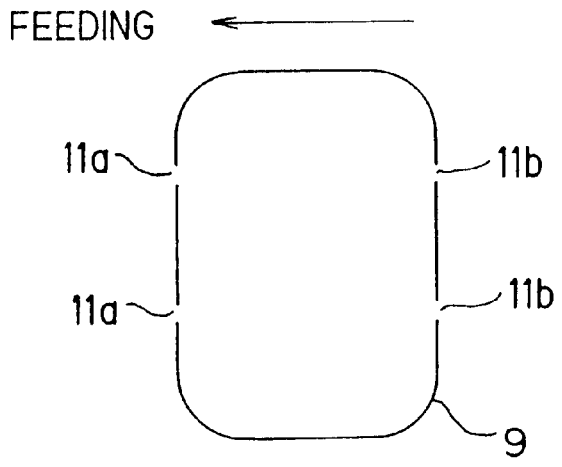
FIG. 4 is a partially enlarged view of the image-receiving sheet as shown in FIG. 3.

FIG. 3 shows a plan view of one example (103) with respect to the second embodiment, and FIG. 4 shows a partially enlarged view thereof. The thermal transfer image-receiving sheet 103 shown in FIG. 3 is subjected to a half-cut process to make the discontinuously cut lines 9, each of which is provided with at least one uncut portion (i.e., a bridge portion) 11. A reference numeral 12 in FIG. 3 indicates a detection mark.

The uncut portion (i.e., the bridge portion) may be provided at any position on the half-cut line 9. In FIG. 4, the area defined by the cut line 9 is provided with four uncut portions. Of these uncut portions, the uncut portions 11*a*, 11*a* are disposed on the feed direction (i.e., the direction indicated by the arrow) side of the thermal transfer image-receiving sheet in the printer, and the uncut portions 11*b*, 11*b* are disposed on the opposite side thereto.

Figure 5:
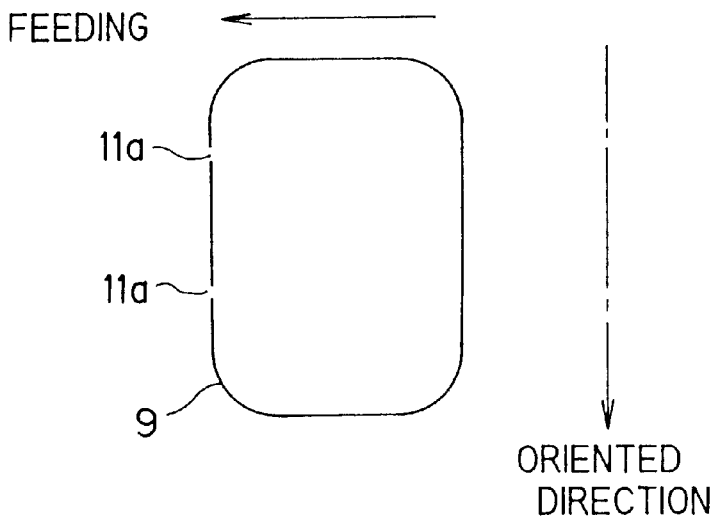
FIG. 5 is a partially enlarged plan view of another example with respect to the second embodiment of the image-receiving sheet.
Figure 6:
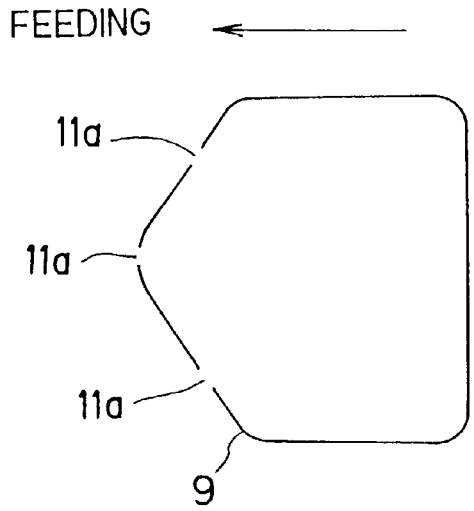
FIG. 6 is a partially enlarged plan view of still another example with respect to the second embodiment of the image-receiving sheet.

Because the edge portion of the feed direction side of the half-cut area is liable to be turned up during the feeding process of the thermal transfer image-receiving sheet in the printer, as shown in FIG. 5 and FIG. 6, it is preferable to provide at least one uncut portion 11*a* on the cut line arranged at the feed direction side of the area, that is, at the side indicated by the arrow.

After the formation of the image, the half-cut area is peeled from the release sheet and stuck to any object. In case where the uncut portion 11 is excessively long, the uncut portion may be not torn along the expected direction when the half-cut area is peeled off, and torn along the direction off from the half-cut line. As a result, an undesirable tearing is frequently caused in the adhesive portion.

Such a problem can be solved by providing an oriented film as one layer in the support 2, and positioning the oriented film so as to make the oriented direction of the oriented film coincident with the direction of the cut line and the uncut portion. For example, in the first embodiment of the present invention mentioned above, the non-foamed resin film in the support may be serve as the above-mentioned oriented film. In this case, the oriented film is preferably laminated as such a non-foamed resin film.

The uncut portion 11 is preferentially provided at the feed direction side of the area defined by the cut line 9 in normal case. Accordingly, when the uniaxial oriented resin film is provided in the support, as shown in FIG. 5, it is preferable to make the oriented direction of the uniaxial oriented resin film coincident with the direction of the uncut portion 11*a* which is arranged at a feed direction side of the area defined by the cut line 9. Beside, when the biaxial oriented resin film which has two oriented directions is provided in the support, it is preferable to make the oriented direction having a higher draw ratio coincident with the direction of the uncut portion which is arranged at a feed direction side of the area defined by the cut line 9.

Figure 7:
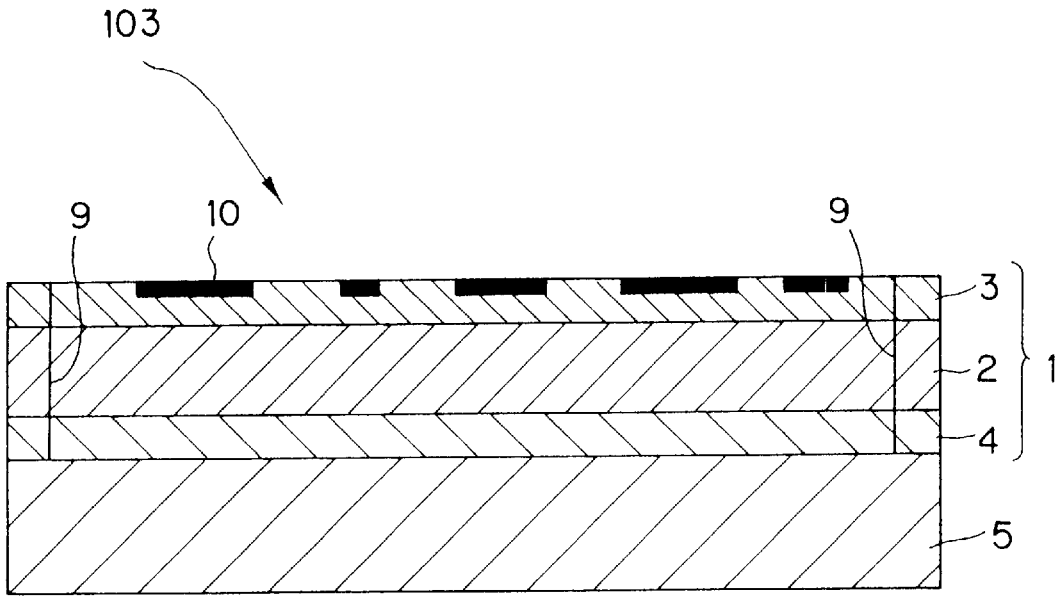
FIG. 7 is a sectional view taken along lines 7—7 of FIG. 3.

FIG. 7 schematically shows a section along lines 7—7 indicated in FIG. 3. The thermal transfer image-receiving sheet 103 shown in FIG. 7 comprises (1) the adhesive sheet portion 1 comprising the support 2, the dye receptor layer 3 disposed on the front surface of the support and the adhesive layer 4 disposed on the back surface of the support and (2) the release sheet 5 temporarily bonded to the adhesive layer side of the adhesive sheet portion so as to be peelable therefrom. The cut line 9 which is provided with the uncut portion is formed in the adhesive sheet portion 1, but the release sheet 5 does not have the cut line.

The thermal transfer image-receiving sheet of the second embodiment of the present invention may have the same laminated structure as that of the first embodiment mentioned above.

As the release sheet 5 used in the second embodiment, there may be used the same sheet as that in the above-mentioned first embodiment.

As to the adhesive for formation of the adhesive layer 4 in the second embodiment, there may also be used the same material and the same forming method as those in the first embodiment.

As the support 2 used in the second embodiment, there may be used any kinds of known conventional supports. Preferable examples include: foamed polypropylene films such as TOYOPEARL SS P4255 (thickness of 35 μm, manufactured by Toyo Boseki Co., Ltd.) and MW247 (thickness of 35 μm, manufactured by Mobil Plastic Europe Co., Ltd.); and foamed polyethylene terephthalate films such as W-900 (thickness of 50 μm, manufactured by Diafoil Co., Ltd.) and E-60 (thickness of 50 μm, manufactured by Toray Co., Ltd.).

The support 2 may be made of foamed resin film. For example, the foamed polyethylene terephthalate film, the foamed polypropylene film and the like may singly be used respectively as the support. Furthermore, the same support as that in the above-mentioned first embodiment may also be used in the second embodiment.

The dye receptor layer 3 may be formed at any stages during the preparing process of the thermal transfer image-receiving sheet of the second embodiment. In case where the thermal transfer image-receiving sheet 103 having the structure shown in FIG. 7 is prepared, for example, the dye receptor layer may previously be formed on the support 2, and otherwise, the dye receptor layer may be formed on the surface of foamed resin film which is the support after the lamination process of the support 2 and the release sheet 5.

When the dye receptor layer 3 is formed in the second embodiment, there may be used the same material and the same forming method as those in the first embodiment. As in the first embodiment, the release agent may also be added into the resin for the dye receptor layer, or applied onto the dye receptor layer in the second embodiment. Furthermore, antistatic agent may also be applied onto the dye receptor layer, as in the first embodiment.

In the second embodiment of the present invention, the thermal transfer image-receiving sheet is subjected to the half-cut process. That is, the cut line is formed only in the adhesive sheet portion 1 of the thermal transfer image-receiving sheet so as to leave at least one portion 11 of the cut line uncut.

As a device for half-cutting, there may be used any known conventional device, for example, a device provided with (1) a level seat made of an elastic body such as rubber, (2) a linear cutter blade which has a predetermined shape, and discontinuous edge portions in correspondence with the position of the above-mentioned uncut portion (i.e., the bridge portion) 11, and which is disposed on the seat so as to be adjustable in its height and (3) an upper die capable of a vertical movement. The half-cut line having a desired shape is able to be formed in the thermal transfer image-receiving sheet by: inserting the thermal transfer image-receiving sheet between the upper die and the seat; adjusting the height of the blade; and vertically moving the die. Needless to say, the rotary cutter of the cylinder type may be used instead of the above-mentioned device.

On the thus prepared thermal transfer image-receiving sheet of the second embodiment, the image can be formed through the known conventional thermal transfer printing method. For example, the image is formed in the half-cut area of the thermal transfer image-receiving sheet through the sublimation thermal transfer printing. Then, the half-cut area in which the image has been given is peeled off, and thereafter stuck to any object.

According to the second embodiment of the present invention, the adhesive sheet portion of the thermal transfer image-receiving sheet is divided into at least one peelable area having an optional shape by the discontinuously cut line. Preferably, at least one portion of the feed direction side of the half-cut area is left uncut. Therefore, there is provided the thermal transfer image-receiving sheet in which there is no occurrence of the peeling of the half-cut area due to the turning up of the edge portion thereof at the time of the printing operation in the thermal transfer printer.

EXAMPLE B

The second embodiment of the present invention will be described hereunder more in detail by way of experiment examples, in which a term "part(s)" or "%" generally denotes weight part(s) or weight %, though not mentioned specifically.

Example B-1

First, the coating material for the dye receptor layer having the following composition was applied onto one surface of the foamed polypropylene film (MW846, thickness of 35 $\mu$m, manufactured by Mobil Co., Ltd.) in an applied amount of 4.0 g/m$^2$ (in solid content), and then dried to form the dye receptor layer.

| <Material For Dye Receptor Layer> | |
|---|---|
| Vinyl chloride - vinyl acetate copolymer (#1000A, manufactured by Denkikagaku Kogyo Co., Ltd.) | 40 parts |
| Polyester (BYLON 600, manufactured by Toyo boseki Co., Ltd.) | 40 parts |
| Vinyl chloride - styrene - acrylic acid copolymer (DENKALAC#400A, manufactured by Denkikagaku Kogyo Co., Ltd.) | 20 parts |
| Vinyl-modified silicone (X-62-1212, manufactured by Shinetsu Kagaku Kogyo Co., Ltd.) | 10 parts |

-continued

| <Material For Dye Receptor Layer> | |
|---|---|
| Catalyst (CAT-PLR-5, manufactured by Shinetsu Kagaku Kogyo Co., Ltd.) | 5 parts |
| Catalyst (CAT-PL-50T, manufactured by Shinetsu Kagaku Kogyo Co., Ltd.) | 6 parts |
| Methyl ethyl ketone/Toluene (1/1) | 400 parts |

Next, the bonding agent having the following composition was applied onto the other surface of the above-mentioned foamed polypropylene film in an applied amount of 3.0 g/m$^2$ (in solid content), on which the dye receptor layer was not formed, and furthermore, the PET film (TRANSPARENT PET T-60, thickness of 25 $\mu$m, manufactured by Toray Co., Ltd.) was placed thereon.

| <Bonding Agent> | |
|---|---|
| Urethane resin (TAKELAC A-969V, manufactured by Takeda Yakuhin Co., Ltd.) | 30 parts |
| Isocyanate curing agent (TAKENATE A-5, manufactured by Takeda Yakuhin Co., Ltd.) | 10 parts |
| Ethyl acetate | 80 parts |

The adhesive having the following composition was applied onto the exposed surface of the thus bonded PET film in an applied amount of 15.0 g/m$^2$ (in solid content), and then dried by heating same at a temperature of 70° C for one minute to form the adhesive layer.

| <Adhesive> | |
|---|---|
| Acrylic copolymer (SK DYNE 1310L, manufactured by Soken Kagaku Co., Ltd.) | 48 parts |
| Epoxy resin (CURING AGENT E-AX, manufactured by Soken Kagaku Co., Ltd.) | 0.36 part |
| Ethyl acetate | 51.64 parts |

On the other hand, the biaxial orientated polypropylene film subjected to no surface treatment (PYLEN P2156, thickness of 50 $\mu$m manufactured by Toyo Boseki Co., Ltd.) was prepared. Then the previously formed layered product mentioned above was laminated on one surface the above biaxial orientated polypropylene film so as to make the adhesive layer side of the layered product opposite to the surface of the biaxial orientated polypropylene film.

Finally, the diluted solution having a diluted ratio of 1/1000 of quaternary ammonium salt compound (TB-34, manufactured by Matsumoto Yushi Seiyaku Co., Ltd.) was applied as the antistatic agent onto the dye receptor layer to prepare the thermal transfer image-receiving sheet.

The thus obtained thermal transfer image-receiving sheet was made into the form shown in FIG. 4 through the half-cut process so as not to cut the portion of the release film, whereby the thermal transfer image-receiving sheet of the present invention having the half-cut areas each of which was provided with uncut portions on its feed direction side and the opposite side thereto was obtained. A size of the each section having a set of the half-cut areas was 110 mm×110 mm, and as shown in FIG. 3, twelve small areas having a size of 20 mm×15 mm respectively were arranged in the each section.

Example B-2

The same steps as those in Example B-1 were carried out to obtain the thermal transfer image-receiving sheet of the present invention having the half-cut areas, except that the uniaxial oriented polyethylene film (CALALIANE Y, thickness of 20 μm, manufactured by Toyo Kagaku Co., Ltd.) was used instead of the PET film of the layered product, and that the uniaxial oriented polyethylene film was positioned so as to cross the oriented direction of the uniaxial oriented polyethylene film and the feed direction of the thermal transfer image-receiving sheet at right angles, and then bonded to the foamed polypropylene film.

Example B-3

First, the same steps as those in Example B-1 were carried out to form the dye receptor layer on one surface of the foamed polypropylene film (MW846, thickness of 35 μm, manufactured by Mobil Co., Ltd.), and the bonding agent was applied onto the other surface of that film on which the dye receptor layer was not formed.

Next, the same steps as those in Example B-2 were carried out to bond the uniaxial oriented polyethylene film (CALALIANE Y, thickness of 20 μm, manufactured by Toyo Kagaku Co., Ltd.) to the bonding layer side of the above-mentioned foamed polypropylene film so as to cross the oriented direction of the uniaxial oriented polyethylene film and the feed direction of the thermal transfer image-receiving sheet at right angles. Thereafter, the adhesive layer was formed on the exposed surface of the uniaxial oriented polyethylene film in the same way as Example B-1.

On the other hand, the PET film (T-60, thickness of 35 μm, manufactured by Toray Co., Ltd.) was subjected to the releasability improving treatment by applying the vinyl-modified silicone onto one surface thereof in an applied amount of 0.3 g/m$^2$ (in solid content), to prepare the release sheet. Then, the previously prepared layered product mentioned above was laminated on the release sheet so as to make the adhesive layer side of the layered product and the release surface of the release sheet opposite to each other.

Finally, the half-cut process was performed in the same way as Example B-1 to obtain the thermal transfer image-receiving sheet of the present invention having the half-cut areas each of which was provided with uncut portions on its feed direction side and the opposite side thereto.

Example B-4

The same steps as those in Example B-1 were carried out to obtain the thermal transfer image-receiving sheet of the present invention having the half-cut areas, except that the biaxial oriented polypropylene film (TORAYFAN YT-22, thickness of 30 μm, manufactured by Toray Co., Ltd.) was used instead of the PET film of the layered product, and that the biaxial oriented polypropylene film was positioned so as to cross the oriented direction having the higher draw ratio of the biaxial oriented polypropylene film and the feed direction of the thermal transfer image-receiving sheet at right angles, and then stuck to the foamed polypropylene film.

Comparative Example B-1

First, the same steps as those in Example B-1 were carried out to form the dye receptor layer on one surface of the foamed polyethylene terephthalate film (W-900, thickness of 50 μm, manufactured by Diafoil Co., Ltd.).

Next, the same steps as those in Example B-1 were carried out to form the adhesive layer on the other surface of above-mentioned foamed polyethylene terephthalate film on which the dye receptor layer was not formed. Thereafter, the biaxial orientated polypropylene film subjected to no surface treatment (PYLEN P2156, thickness of 50 μm manufactured by Toyo Boseki Co., Ltd.) was laminated on the surface of the adhesive layer, and furthermore the diluted solution having a diluted ratio of 1/1000 of quaternary ammonium salt compound (TB-34, manufactured by Matsumoto Yushi Seiyaku Co., Ltd.) was applied as the antistatic agent onto the dye receptor layer to prepare the thermal transfer image-receiving sheet.

The thus prepared thermal transfer image-receiving sheet was made into the form shown in FIG. 5 through the half-cut process so as not to cut the portion of the release film, whereby the thermal transfer image-receiving sheet of the comparative example having the half-cut areas each of which was provided with uncut portions on only its feed direction side was obtained. A size of the each section having a set of the half-cut areas was 110 mm×110 mm, and twelve small areas having a size of 20 mm×15 mm respectively were arranged in the each section.

Comparative Example B-2

The same steps as those in Comparative Example B-1 were carried out to obtain the thermal transfer image-receiving sheet of the comparative example having the half-cut areas, except that the polyethylene terephthalate film (T-60, thickness of 35 μm, manufactured by Toray Co., Ltd.) which was subjected to releasability improving treatment by applying the vinyl-modified silicone onto the surfaces thereof in applied amount of 0.3 g/m$^2$ (in solid content) was used as the release sheet instead of the biaxial oriented polypropylene film subjected to no surface treatment.

Comparative Example B-3

The same thermal transfer image-receiving sheet as that in Comparative Example B-2 was prepared, and made into the form shown in FIG. 8 through the half-cut process, to obtain the thermal transfer image-receiving sheet of the comparative example which is not provided with the uncut portion.

Comparative Example B-4

The same thermal transfer image-receiving sheet as that in Example B-3 was prepared, and made into the form shown in FIG. 8 through the half-cut process, to obtain the thermal transfer image-receiving sheet of the comparative example which is not provided with the uncut portion.

[Test And Results]

Each of the obtained thermal transfer image-receiving sheets was subjected to the sublimation thermal transfer printing in the same way as that in Example A series.

That is, the sublimation thermal transfer sheet (manufactured by Dai Nippon Printing Co., Ltd.) on which three colors of the dye layers consisting of yellow (Y), cyan (C) and magenta (M) were alternately and sequentially arranged side by side was laid on each thermal transfer image-receiving sheet of the examples or the comparative examples so as to make the dye layer and the dye receptor layer opposite to each other.

Next, the thermal transfer sheet was heated from its back surface side by the thermal head under the condition consisting of an applied head-voltage of 12.0 V, a pulse width of 16 msec., a printing cycle of 33.3 msec. and a dot density of 6 dots/line to record on the thermal transfer image-receiving sheet, whereby the photograph of the portrait in various colors was printed on the dye receptor layer of the thermal transfer image-receiving sheet.

In Example B series, the thermal transfer image-receiving sheet was tested with respect to feeding property during the printing process. Furthermore, the printed matter thus obtained was tested with respect to quality of the image, density of coloring, adhesive strength and handling property at the time of peeling. The method and criterion for each evaluation are as follows. The results are shown in TABLE 2.

<Feeding Property>

The feeding property was evaluated by counting the number of times of interruption during the printing operation of the printer, when the images were continuously formed to one hundred pieces of the thermal transfer image-receiving sheet.

Criterion

Good: The Number of interruption is not more than two times.

Not Good: The Number of interruption is not less than twenty times.

<Image Quality>

The quality of the image was evaluated by visual observation on the basis of the following criterion.

Criterion

◎: The image is extremely excellent in expression of light and shade, clear and powerful.

○: The image is excellent in expression of light and shade, clear and powerful.

×: The image is flat-looking and blur.

<Density Of Coloring>

The density of coloring was measured by the densitometer (RD-918, manufactured by Macbeth Co., Ltd. in USA)

<Adhesive Strength (Peel Strength)>

The adhesive strength between the release sheet and the adhesive layer was measured through JIS P8139 test with the use of the sample piece having a width of 35 mm.

<Handling Property>

The handling property at the time when the half-cut area was peeled off after formation of image was evaluated.

Criterion

◎: The half-cut area is smoothly peeled off without sticky feeling at the bridge portion (i.e., the uncut portion), and the bridge portion is uniformly torn.

○: The half-cut area is smoothly peeled off though sticky feeling is caused a little at the bridge portion, and the bridge portion is uniformly torn.

Δ: Sticky feeling is caused a little at the bridge portion, and the bridge portion is not uniformly torn.

×: Sticky feeling is caused a little at the bridge portion, and the half-cut portion is torn along a side direction from the bridge portion.

TABLE 2

| Number of Example | Feeding property | Image Quality | Density of Coloring | Adhesive Strength (gf) | Handling Property |
|---|---|---|---|---|---|
| Example B-1 | Good | ◎ | 2.56 | 710 | Δ |
| Example B-2 | Good | ◎ | 2.56 | 37 | ◎ |
| Example B-3 | Good | ◎ | 2.56 | 37 | ◎ |
| Example B-4 | Good | ◎ | 2.56 | 37 | ◎ |
| Comparative Example B-1 | Good | ○ | 1.93 | 690 | Δ |
| Comparative Example B-2 | Good | ○ | 1.93 | 37 | Δ |
| Comparative Example B-3 | Not Good | ○ | 1.93 | 37 | — |
| Comparative Example B-4 | Not Good | ◎ | 2.56 | 37 | — |

What is claimed is:

1. An image-receiving sheet for thermal transfer printing comprising: an adhesive sheet portion comprising a support, a dye receptor layer disposed on a front surface of said support and an adhesive layer disposed on a back surface of said support; and a release sheet temporarily bonded to said adhesive layer of said adhesive sheet portion so as to be peelable therefrom, wherein said support is a layered product essentially consisting of only one foamed resin film layer disposed on a dye receptor layer side of said support and only one non-foamed resin film layer disposed on an adhesive layer side of said support, and said adhesive sheet portion has at least one half-cut line by each of which said adhesive sheet portion is divided into an area having a predetermined shape, each said area of said adhesive sheet portion being peelable from said release sheet.

2. An image-receiving sheet for thermal transfer printing according to claim 1, wherein said foamed resin film layer is a foamed polypropylene resin film layer.

3. An image-receiving sheet for thermal transfer printing according to claim 1, wherein said release sheet is a plastic film.

4. An image-receiving sheet for thermal transfer printing according to claim 3, wherein said plastic film has a thickness of 20 to 100 $\mu$m.

5. An image-receiving sheet for thermal transfer printing according to claim 1, wherein said half-cut line for said area is provided with at least one uncut portion.

6. An image-receiving sheet for thermal transfer printing according to claim 5, wherein said uncut portion is provided on said cut line arranged along one side of said area.

7. An image-receiving sheet for thermal transfer printing according to claim 1, wherein said non-foamed resin film layer comprises a layer of an uniaxial oriented resin film positioned so as to make an oriented direction of said uniaxial oriented resin film coincident with a direction of said cut line arranged along one side of said area.

8. An image-receiving sheet for thermal transfer printing according to claim 1, wherein said non-foamed resin film layer comprises a layer of a biaxial oriented resin film positioned so as to make an oriented direction having a higher draw ratio of said biaxial oriented resin film coincident with a direction of said cut line arranged along one side of said area.

9. An image-receiving sheet for thermal transfer printing according to claim 5, wherein said release sheet is a plastic film.

10. An image-receiving sheet for thermal transfer printing according to claim 9, wherein said plastic film has a thickness of 20 to 100 $\mu$m.

* * * * *